United States Patent [19]

Case

[11] 4,252,892

[45] Feb. 24, 1981

[54] PHOTOGRAPHIC COLOR DEVELOPER COMPOSITIONS

[75] Inventor: Nelson S. Case, Rochester, N.Y.

[73] Assignee: Eastman Kodak Company, Rochester, N.Y.

[21] Appl. No.: 101,664

[22] Filed: Dec. 10, 1979

[51] Int. Cl.[3] ..... G03C 5/30

[52] U.S. Cl. ..... 430/357; 430/433; 430/444; 430/467; 430/488; 430/489; 430/490; 430/491

[58] Field of Search ..... 430/357, 444, 467, 488, 430/490, 491, 433

[56] References Cited

U.S. PATENT DOCUMENTS

| | | | |
|---|---|---|---|
| 2,875,049 | 2/1969 | Kridel | 430/490 |
| 3,462,269 | 8/1969 | Tassone | 430/491 |
| 3,558,314 | 1/1971 | Hueckstaedt et al. | 430/444 |
| 3,619,185 | 11/1971 | Kasman | 430/444 |
| 3,746,544 | 7/1973 | Heilmann | 430/490 |
| 3,811,888 | 5/1974 | Shibaoka et al. | 430/491 |
| 3,833,378 | 9/1974 | Hayashi et al. | 430/490 |
| 3,841,873 | 10/1974 | Mowrey et al. | 430/373 |
| 3,846,133 | 11/1974 | Zorn et al. | 430/505 |
| 3,994,730 | 11/1976 | Frank et al. | 430/490 |
| 4,045,226 | 8/1977 | Hara et al. | 430/373 |
| 4,170,478 | 10/1979 | Case et al. | 430/490 |

FOREIGN PATENT DOCUMENTS

| | | | |
|---|---|---|---|
| 1420656 | 1/1976 | United Kingdom | 430/491 |

OTHER PUBLICATIONS

Research Disclosure, vol. 164, Item 16480, Dec. 1977.

*Primary Examiner*—J. Travis Brown
*Attorney, Agent, or Firm*—A. P. Lorenzo

[57] ABSTRACT

A poly(alkyleneimine), such as poly(ethyleneimine), is incorporated in a photographic color developer composition containing a primary aromatic amino color developing agent in order to protect the developing agent against aerial oxidation. The poly(alkyleneimine) also functions to reduce tar formation and retard stain growth and provides a supplemental source of alkalinity in the color developer composition.

20 Claims, No Drawings

PHOTOGRAPHIC COLOR DEVELOPER COMPOSITIONS

BACKGROUND OF THE INVENTION

1. Field of the Invention

This invention relates in general to color photography and in particular to new and improved color developing compositions and processes for forming photographic color images. More specifically, this invention relates to color development with a color developing composition containing a primary aromatic amino color developing agent and an anti-oxidant which serves to protect the developing agent against aerial oxidation.

2. Description of the Prior Art

The formation of color photographic images by the image-wise coupling of oxidized primary aromatic amino developing agents with color forming or coupling compounds to form indoaniline, indophenol, and azomethine dyes is well known. In these processes, the subtractive process of color formation is ordinarily used and the image dyes customarily formed are cyan, magenta, and yellow, the colors that are complementary to the primary colors, red, green, and blue, respectively. Usually, phenol or naphthol couplers are used to form the cyan dye image; pyrazolone or cyanoacetyl derivative couplers are used to form the magenta dye image; and acylacetamide couplers are used to form the yellow dye image.

In these color photographic systems, the color-forming coupler may be either in the developer solution or incorporated in the light-sensitive photographic emulsion layer so that, during development, it is available in the emulsion layer to react with the color developing agent that is oxidized by silver image development. Diffusible couplers are used in color developer solutions. Nondiffusing couplers are incorporated in photographic emulsion layers. When the dye image formed is to be used in situ, couplers are selected which form nondiffusing dyes. For image transfer color processes, couplers are used which will produce diffusible dyes capable of being mordanted or fixed in the receiving sheet.

It is common practice in the photographic art to include a sulfite in color developer compositions containing primary aromatic amino color developing agents. Typically, the sulfite utilized is in the form of an alkali metal sulfite or bisulfite. It is employed for the purpose of retarding aerial oxidation of the primary aromatic amino color developing agent and is generally quite effective for this purpose. However, the amount of sulfite which can be tolerated in the developer solution is limited by the fact that sulfite competes with couplers for oxidized developing agent and thereby adversely affects dye formation. Typically, yellow-dye-forming couplers react with oxidized developing agent more slowly than cyan-dye-forming couplers or magenta-dye-forming couplers so that the competition between coupler and sulfite has the greatest adverse effect on the formation of the yellow dye image.

Current trends in photographic processing favor lower replenishment rates in color processes, and these have presented problems associated with lower turnover rates and higher concentrations of replenisher ingredients. Lower turnover rates result in longer residence time for solutions in the processor. This produces greater aerial oxidation of the developing agent. This tendency can be counteracted by increasing the concentration of sulfite in the developer solution but, in turn, this results in adverse effects on the dye images, especially a lowering of yellow shoulder and yellow $D_{max}$, because of the fact that sulfite competes with couplers for oxidized developing agent. Thus, if the amount of sulfite is kept low enough that the decrease in yellow dye density is slight, then the developing solution will not have adequate protection against aerial oxidation while if the amount of sulfite is increased to provide adequate protection against aerial oxidation, then the adverse effects on dye density will be severe and may reach unacceptable levels.

Other anti-oxidants, in addition to sulfites, which function to protect developing agents against aerial oxidation are known, and these can be used by themselves or in combination with a sulfite in photographic color developer compositions. For example, it is well known to use an hydroxylamine in a color developer composition to provide protection against aerial oxidation. Such use is described, for example, in U.S. Pat. Nos. 2,879,049, 3,462,269, 3,746,544 and 3,994,730. However, hydroxylamines are generally incapable of providing adequate protection against aerial oxidation when used as the sole anti-oxidant in color developer compositions that are subjected to conditions where aerial oxidation is a severe problem. As disclosed in U.S. Pat. No. 4,170,478, "Photographic Color Developer Compositions," by Nelson S. Case and Danny L. Wyatt, issued Oct. 9, 1979, particularly effective results are obtained by use of an hydroxylamine in combination with a member selected from the group consisting of alkanolamines which are free of carboxyl substitution, aliphatic monoamino monocarboxylic acids of up to three carbon atoms, and aminobenzoic acids.

It is toward the objective of providing an anti-oxidant which is highly effective in retarding aerial oxidation of primary aromatic amino color developing agents, when used either by itself or in combination with other anti-oxidants, and which, unlike sulfites, does not compete with couplers for oxidized developing agent, that the present invention is directed.

SUMMARY OF THE INVENTION

It has now been discovered that photographic color developer compositions containing a primary aromatic amino color developing agent can be protected against aerial oxidation by addition thereto of a poly(alkyleneimine), such as poly(ethyleneimine). The poly(alkyleneimine) will provide effective protection against oxidation without adversely affecting the density of the dye images. By its use, it is possible to greatly reduce or completely eliminate sulfite, to thereby reduce or avoid the deleterious effects of sulfite on the dye images. In addition to providing protection against aerial oxidation, the poly(alkyleneimine) also functions to reduce tar formation and retard stain growth and provides a supplemental source of alkalinity in color developer compositions. Moreover, the poly(alkyleneimine) can be effectively used to provide protection against aerial oxidation in alkaline solutions, such as working developer solutions, and in acidic solutions, such as acidic developer concentrates that are commonly used in the packaging of photographic color developers.

DESCRIPTION OF THE PREFERRED EMBODIMENTS

The primary aromatic amino color developing agents that can be utilized in the compositions and methods of this invention are well known and widely used in a variety of color photographic processes. They include aminophenols and p-phenylenediamines. They are usually used in the salt form, such as the hydrochloride or sulfate, as the salt form is more stable than the free amine, and are generally employed in concentrations of from about 0.1 to about 20 grams per liter of developing solution and more preferably from about 0.5 to about 10 grams per liter of developing solution.

Examples of aminophenol developing agents include o-aminophenol, p-aminophenol, 5-amino-2-hydroxytoluene, 2-amino-3-hydroxy-toluene, 2-hydroxy-3-amino-1,4-dimethyl-benzene, and the like.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include:

N,N-diethyl-p-phenylenediamine monohydrochloride;

4-N,N-diethyl-2-methylphenylenediamine monohydrochloride;

4-(N-ethyl-N-2-methanesulfonylaminoethyl)-2-methylphenylenediamine sesquisulfate monohydrate;

4-(N-ethyl-N-2-hydroxyethyl)-2-methylphenylenediamine sulfate;

4-N,N-diethyl-2,2'-methanesulfonylaminoethylphenylenediamine hydrochloride; and the like.

An especially preferred class of p-phenylenediamine developing agents are those containing at least one alkylsulfonamidoalkyl substituent attached to the aromatic nucleus or to an amino nitrogen. Other especially preferred classes of p-phenylenediamines are the 3-alkyl-N-alkyl-N-alkoxyalkyl-p-phenylenediamines and the 3-alkoxy-N-alkyl-N-alkoxyalkyl-p-phenylenediamines. These developing agents are described in U.S. Pat. Nos. 3,656,950 and 3,658,525, and can be represented by the formula:

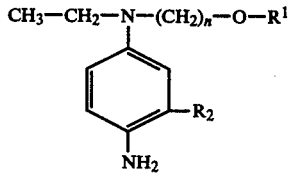

where n is an integer having a value of from 2 to 4, $R^1$ is alkyl of from 1 to 4 carbon atoms, and $R^2$ is alkyl of from 1 to 4 carbon atoms or alkoxy of from 1 to 4 carbon atoms. Illustrative examples of these developing agents include the following compounds:

N-ethyl-N-methoxyethyl-3-methyl-p-phenylenediamine,

N-ethyl-N-methoxybutyl-3-methyl-p-phenylenediamine,

N-ethyl-N-ethoxyethyl-3-methyl-p-phenylenediamine,

N-ethyl-N-methoxyethyl-3-n-propyl-p-phenylenediamine,

N-ethyl-N-methoxyethyl-3-methoxy-p-phenylenediamine,

N-ethyl-N-butoxyethyl-3-methyl-p-phenylenediamine, and the like.

In addition to the primary aromatic amino color developing agent, the color developer compositions of this invention include an oxidation-inhibiting amount of a poly(alkyleneimine). The poly(alkyleneimines) are comprised of repeating alkylene chain units, substituted or unsubstituted, interconnected by nitrogen. They are well known commercially available materials. Typical poly(alkyleneimines) are those represented by the formula:

$$\text{-}(R\text{—}NH)_X\text{-}$$

where R represents an alkylene radical, preferably containing 2 to 4 carbon atoms, and X represent the number of repeating units in the polymer chain, and is typically in the range from about 500 to about 2,000. The molecular weight is not critical for the purposes of this invention, except that it should not be so high as to render the poly(alkyleneimine) insoluble in the photographic color developer composition. Preferred poly(alkyleneimines) for the purpose of this invention are poly(ethyleneimines) of the formula:

$$\text{-}(CH_2\text{—}CH_2\text{—}NH)_X\text{-}$$

where X is an integer having a value in the range of from about 500 to about 2,000, corresponding to a molecular weight in the range of from about 20,000 to about 80,000.

Illustrative examples of poly(alkyleneimines) that can be used in the color developer compositions of this invention include:

poly(ethyleneimine), poly(propyleneimine), poly(buteneimine), poly(isobuteneimine), poly(N-methylethyleneimine), poly(N-beta-hydroxyethylethyleneimine), poly(2,2-dimethylethyleneimine), poly(2-ethylethyleneimine), poly(2-methylethyleneimine), and the like.

The poly(alkyleneimine) can be used in the color developer composition in any amount that will serve as an oxidation-inhibiting amount. Preferably, the poly(alkyleneimine) is used in an amount of from about 6 to about 1200 grams per mole of primary aromatic amino color developing agent, and most preferably from about 80 to about 400 grams per mole.

Sulfite has long been considered by those skilled in the art of photographic processing to be an essential component of color developer compositions, and it was unexpected and surprising to find that it could be omitted from compositions containing a poly(alkyleneimine). The poly(alkyleneimine) can, of course, also be incorporated in color developer compositions which do contain sulfite, to obtain the advantage of increased protection against aerial oxidation and consequent prolonged life, but without the benefit of eliminating the adverse effects of sulfite on dye image densities. Use of a poly(alkyleneimine) has other important advantageous benefits, whether or not sulfite is omitted. For example, it reduces tar formation, retards stain growth, and provides a supplemental source of alkalinity. It also acts as a solubilizing agent for the developing agent and for benzyl alcohol.

The poly(alkyleneimines) can be utilized in color developer compositions by themselves or in combination with other anti-oxidants, such as sulfites, hydroxylamines and alkanolamines. They can be advantageously employed in working developer solutions, in replenisher solutions, and in developer concentrates utilized to facilitate packaging of color developer compositions in kit form. Use of poly(alkyleneimines) in acidic concentrates is especially advantageous as an alternative to the conventional use of a sulfite, since sulfites tend to give off noxious sulfur dioxide fumes at the low pH levels employed in these concentrates.

As used herein, the term "an hydroxylamine" refers to an amine in which the nitrogen atom is directly attached to an hydroxyl radical, i.e., the amine comprises an hydroxy amino group of the formula >N—OH, and the term "an alkanolamine" refers to an amine in which the nitrogen atom is directly attached to an hydroxyalkyl radical, i.e., the amine comprises an >N—X—OH group wherein X is alkylene.

The radicals attached to the free bonds in the aforesaid >N—OH and >N—X—OH groups can be hydrogen atoms or organic radicals, e.g., unsubstituted hydrocarbon radicals or substituted hydrocarbon radicals. They are preferably hydrogen atoms or hydrocarbyl radicals of 1 to 12 carbon atoms, for example, alkyl, aryl, alkaryl, or aralkyl radicals. Particularly useful alkanolamines are alkanolamines which are secondary monoamines, tertiary monoamines, secondary diamines, or tertiary diamines.

In a preferred embodiment of this invention, the color developer composition contains a combination of an hydroxylamine and a poly(alkyleneimine). Such combinations have been found to be exceptionally effective in prolonging the useful life of color developer compositions, while being substantially free of adverse effects on the dye images. Other preferred embodiments of the invention include a combination of a poly(alkyleneimine) and an alkanolamine and a combination of an hydroxylamine, a poly(alkyleneimine) and an alkanolamine.

Optional ingredients which can be included in the color developer compositions of this invention include alkalies to control pH, thiocyanates, bromides, iodides, benzyl alcohol, thickening agents, solubilizing agents, sequestering agents, brightening agents, and so forth. The pH of the working developer solution is ordinarily above 7 and most typically about 10 to about 13. On the other hand, the pH of acidic developer concentrates is typically about 0.5 to about 3.5.

Hydroxylamine can be utilized in the color developer compositions of this invention in the form of the free amine, but is more typically employed in the form of a water-soluble acid salt. Typical examples of such salts are sulfates, oxalates, chlorides, phosphates, carbonates, acetates, and the like. The hydroxylamine can be substituted or unsubstituted, for example, the nitrogen atom of the hydroxylamine can be substituted with alkyl radicals. Preferred hydroxylamines are those of the formula:

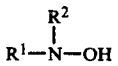

wherein $R^1$ and $R^2$ are independently selected from the group consisting of a hydrogen atom and an alkyl group of 1 to 3 carbon atoms, and water-soluble acid salts thereof.

In accordance with this invention, an hydroxylamine is preferably included in the color developer composition in an amount of from about 1 to about 8 moles per mole of primary aromatic amino color developing agent, more preferably in an amount of from about 2 to about 7 moles per mole, and most preferably in an amount of from about 3 to about 5 moles per mole. Advantageously, the color developer composition is free of sulfite or contains only a low concentration of sulfite, i.e., an amount of sulfite not exceeding 0.25 moles per mole of primary aromatic amino color developing agent. However, the invention broadly encompasses the use of a poly(alkyleneimine), in any amount that is sufficient to retard aerial oxidation of the developing agent, and includes developer compositions which include sulfite in any amount as well as those which are free of sulfite, and developer compositions which include hydroxylamines in any amount as well as those which are free of hydroxylamines.

Development of photographic elements in the color developer compositions described herein can be advantageously employed in the processing of photographic elements designed for reversal color processing or in the processing of negative color elements or color print materials. The poly(alkyleneimines) can be employed with photographic elements which are processed in color developers containing couplers or with photographic elements which contain the coupler in the silver halide emulsion layers or in layers contiguous thereto. The photosensitive layers present in the photographic elements processed according to the method of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

Typical examples of photographic elements which can be advantageously utilized in the method described herein are those described in Edens and VanCampen, U.S. Pat. No. 3,582,322 issued June 1, 1971, Evans, U.S. Pat. No. 3,622,318 issued Nov. 23, 1971, and Abbott, U.S. Pat. No. 3,730,724 issued May 1, 1973.

Processes employing the color developer compositions of this invention can vary widely in regard to such features as development time and development temperature. Thus, for example, the development time will typically be in the range from about 0.5 to about 20 minutes, and more usually in the range from about 1 to about 4 minutes, while the development temperature will typically be in the range from about 15° C. to about 55° C., and more usually in the range from about 25° C. to about 40° C.

The invention is further illustrated by the following examples of its practice.

EXAMPLE 1

A photographic color developer composition which did not contain any anti-oxidants, referred to hereinafter as Developer 1, was formulated to contain 4.25 grams per liter of 4-(N-ethyl-N-2-methanesulfonylaminoethyl)-2-methylphenylenediamine sesquisulfate monohydrate, 17.7 milliliters per liter of benzyl alcohol, 31 grams per liter of potassium carbonate, 0.17 grams per liter of potassium bromide, and 2.1 grams per liter of potassium chloride. It also contained sequestering and brightening agents. It had a pH of 10.05.

Color developer compositions, referred to hereinafter as Developers 2 to 9, were prepared in accordance with the same formulation as Developer 1, except that they contained anti-oxidants as indicated in Table I, and with the further exception that Developers 4 and 5 contained only 0.133 grams per liter of potassium bromide and additionally contained 12 milligrams per liter of a mercaptan.

Each of the color developer compositions was stored at room temperature in an open glass beaker and, at weekly intervals, a photographic color print paper comprising a polyethylene-coated paper base bearing in order a blue-light-sensitive gelatin silver halide emulsion layer containing a yellow-dye-forming coupler, a green-light-sensitive gelatin silver halide emulsion layer containing a magenta-dye-forming coupler and a red-light-sensitive gelatin silver halide emulsion layer containing a cyan-dye-forming coupler, was exposed, developed in the color developer composition, bleach-fixed, washed, and tested to determine the maximum density of the yellow dye image. In Table I, the symbols HAS, $SO_3^=$, TEA and PEI refer, respectively, to hydroxylamine sulfate, the sulfite ion (which was incorporated in the developer solution as potassium sulfite), triethanolamine and poly(ethyleneimine). The concentrations reported are molar concentrations, with the molar value assigned to PEI being based on the molecular weight of the repeating unit rather than on the molecular weight of the polymer. The molecular weight of the PEI utilized was about 50,000. Values reported in Table I are, in each instance, the yellow $D_{max}$ after the specified number of weeks of storage.

TABLE I

| Developer | 1 | 2 | 3 | 4 | 5 | 6 | 7 | 8 | 9 |
|---|---|---|---|---|---|---|---|---|---|
| Concentration of HAS | 0 | 0.029 | 0.083 | 0 | 0 | 0 | 0.029 | 0.029 | 0.029 |
| Concentration of $SO_3^=$ | 0 | 0 | 0 | 0.035 | 0 | 0 | 0.054 | 0 | 0 |
| Concentration of TEA | 0 | 0 | 0 | 0 | 0.054 | 0 | 0 | 0.054 | 0 |
| Concentration of PEI | 0 | 0 | 0 | 0 | 0 | 0.054 | 0 | 0 | 0.054 |
| Weeks | | | | | | | | | |
| 0 | 2.22 | 2.27 | 2.30 | 2.06 | 2.35 | 2.19 | 1.90 | 2.37 | 2.28 |
| 1 | 2.22 | 2.30 | 2.21 | 2.03 | 2.31 | 2.19 | 1.77 | 2.32 | 2.36 |
| 2 | 1.68 | 2.36 | 2.26 | 1.90 | 2.07 | 2.08 | 1.95 | 2.31 | 2.30 |
| 3 | 1.52 | 2.05 | 2.30 | 1.28 | 1.69 | 2.12 | 1.65 | 2.28 | 2.28 |
| 4 | 0.96 | 1.38 | 2.32 | 0.84 | 1.39 | 2.05 | 1.63 | 2.29 | 2.36 |
| 5 | 0.51 | 1.17 | 1.53 | 0.31 | 0.76 | 1.80 | 1.82 | 2.22 | 2.20 |
| 6 | 0.24 | 0.67 | 1.47 | 0 | 0.51 | 1.52 | 1.87 | 2.31 | 2.13 |
| 7 | 0 | 0.45 | 1.04 | 0 | 0.16 | 1.25 | 1.77 | 2.12 | 2.18 |
| 8 | 0 | 0.20 | 0.82 | 0 | 0 | 1.22 | 1.38 | 1.97 | 2.00 |
| 9 | 0 | 0 | 0.47 | 0 | 0 | 0.88 | 1.63 | 1.62 | 1.96 |
| 10 | 0 | 0 | 0.07 | 0 | 0 | 0.88 | 1.31 | 1.12 | 2.07 |
| 11 | 0 | 0 | 0 | 0 | 0 | 0.62 | 1.27 | 0.88 | 2.10 |
| 12 | 0 | 0 | 0 | 0 | 0 | 0.43 | 0.95 | 0.80 | 1.38 |
| 13 | 0 | 0 | 0 | 0 | 0 | 0.22 | 0.91 | 0.44 | 1.31 |
| 14 | 0 | 0 | 0 | 0 | 0 | 0.05 | 0.73 | 0.11 | 1.15 |
| 15 | 0 | 0 | 0 | 0 | 0 | 0 | 0.56 | 0 | 0.85 |
| 16 | 0 | 0 | 0 | 0 | 0 | 0 | 0.38 | 0 | 0.63 |
| 17 | 0 | 0 | 0 | 0 | 0 | 0 | 0 | 0 | 0.36 |
| 18 | 0 | 0 | 0 | 0 | 0 | 0 | 0 | 0 | 0.10 |
| 19 | 0 | 0 | 0 | 0 | 0 | 0 | 0 | 0 | 0 |

As shown by the data in Table I, Developer 1, which contained no anti-oxidants, had a relatively short useful like such that a yellow $D_{max}$ of zero was obtained after only seven weeks of storage. Developers 2 and 3, each of which contained hydroxylamine sulfate as anti-oxidant, with Developer 3 having a higher concentration of hydroxylamine sulfate than Developer 2, showed improved stability as compared with Developer 1. In particular, with Developer 3, a yellow $D_{max}$ of zero was not obtained until after eleven weeks of storage. Developer 4 contained potassium sulfite as anti-oxidant and the results obtained show that, at the concentration used, it was ineffective in providing protection, since the yellow $D_{max}$ reached a value of zero after only six weeks of storage. Developer 5 contained triethanolamine as anti-oxidant and, in this case, the yellow $D_{max}$ reached a value of zero after eight weeks of storage. Developer 6, in which the anti-oxidant is poly(ethyleneimine), is a developer composition prepared in accordance with the present invention. In this case, the yellow $D_{max}$ reached a value of zero after fifteen weeks of storage. In Developer 7, the protection against oxidation was provided by a combination of hydroxylamine sulfate and potassium sulfite, with the potassium sulfite being used at a higher level than in Developer 4. This combination is very effective in that the yellow $D_{max}$ did not reach a value of zero until seventeen weeks. However, it suffers from a serious disadvantage in that the initial density, that is the density at the start of the test, was only 1.90 as compared to 2.19 with Developer 6. This low initial density is a result of the fact that sulfite competes for oxidized developing agent with the yellow-dye-forming coupler, thereby causing a loss in density. In Developer 8, the protection against oxidation was provided by a combination of hydroxylamine sulfate and triethanolamine. This combination of compounds provides excellent results in that the initial value of yellow $D_{max}$ was high, and a value of zero was not reached until after fifteen weeks of storage. The use of a combination of hydroxylamine sulfate and triethanolamine to retard aerial oxidation in photographic color developer compositions is disclosed and claimed in U.S. Pat. No. 4,170,478. In Developer 9, the protection against oxidation was provided by a combination of hydroxylamine sulfate and poly(ethyleneimine). This combination represents a preferred embodiment of the present invention. It provides excellent results in that the initial value of yellow $D_{max}$ was high and the value did not reach zero until nineteen weeks of storage. Moreover, a yellow $D_{max}$ greater than 2 was still obtained even after eleven weeks of storage, whereas this was not the case with any of the other developer compositions described in Table I.

EXAMPLE 2

To demonstrate the effectiveness of poly(ethyleneimines) in retarding oxidation of color developing agents in acidic developer concentrates, ten samples of concentrate were prepared in accordance with the formulations described in Table II. Each of these concentrates was stored in an open beaker for a period of one month and then used to prepare a color developer composition similar to that described in Example 1, using 22.5 milliliters of concentrate to prepare one liter of developer. Each color developer composition was used in processing a sample of the color print paper described in Example 1, and the maximum density of the yellow dye image was measured. In addition, each color developer composition was analyzed to determine the concentration of the developing agent.

TABLE II

| Sample No. | Color Developing Agent* (grams/liter) | $K_2SO_3$ (grams/liter) | $H_3PO_4$ (milliliters /liter) | 50% Solution of poly-(ethylene-imine) (milliliters /liter) | $H_2SO_4$ (milliliters /liter) | Yellow $D_{max}$ | Analyzed concentration of Color Developing Agent (grams /liter) |
|---|---|---|---|---|---|---|---|
| 1 | 194 | 0 | 0 | 0 | 0 | 0.83 | 1.4 |
| 2 | 194 | 13.3 | 0 | 0 | 0 | 0.98 | 1.9 |
| 3 | 194 | 0 | 311 | 290 | 0 | 1.15 | 3.1 |
| 4 | 194 | 0 | 266 | 290 | 0 | 1.23 | 3.2 |
| 5 | 194 | 0 | 222 | 290 | 0 | 1.34 | 3.7 |
| 6 | 194 | 13.3 | 311 | 290 | 0 | 1.61 | 3.7 |
| 7 | 194 | 13.3 | 266 | 290 | 0 | 1.63 | 3.9 |
| 8 | 194 | 13.3 | 222 | 290 | 0 | 2.02 | 4.0 |
| 9 | 194 | 0 | 0 | 290 | 100 | 1.14 | 3.4 |
| 10 | 194 | 13.3 | 0 | 290 | 100 | 1.30 | 3.6 |

*4-(N-ethyl-N-2-methanesulfonylaminoethyl)-2-methylphenylenediamine sesquisulfate monohydrate As shown by the data in Table II, in Sample 1 there was considerable loss of color developing agent during the one month storage period. Since 22.5 milliliters of concentrate was used to prepare one liter of color developer composition, if no color developing agent had been lost on storage, the concentration would have been $22.5/1000 \times 194 = 4.37$ grams/liter. However, the concentration of developing agent in the color developer composition prepared from Sample 1 was only 1.4 grams/liter, indicating that a majority of the developing agent was lost as a result of oxidation on storage. The yellow $D_{max}$ obtained with the color developer composition prepared from Sample 1 was correspondingly low. In Sample 2, potassium sulfite was used to protect the developing agent against oxidation during storage of the concentrate, and results were slightly improved, but still poor. In each of Samples 3 to 10, poly(ethyleneimine) was used to protect the developing agent against oxidation during storage of the concentrate, and greatly improved results were obtained, as indicated by both the higher values for yellow $D_{max}$ and the higher concentrations of developing agent found upon analysis. The best results were obtained with Samples 6, 7, and 8 in which protection against aerial oxidation was provided by use of a combination of potassium sulfite and poly(ethyleneimine).

The invention has been described in detail with particular reference to preferred embodiments thereof, but it will be understood that variations and modifications can be effected within the spirit and scope of the invention.

I claim:

1. A photographic color developer composition comprising a primary aromatic amino color developing agent and an oxidation-inhibiting amount of a poly(alkyleneimine).

2. A photographic color developer composition comprising a primary aromatic amino color developing agent and an oxidation-inhibiting amount of poly(ethyleneimine).

3. A photographic color developer composition comprising a primary aromatic amino color developing agent, an hydroxylamine, and an oxidation-inhibiting amount of a poly(alkyleneimine).

4. A photographic color developer composition comprising a primary aromatic amino color developing agent, from about 1 to about 8 moles per mole of said developing agent of an hydroxylamine of the formula:

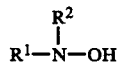

wherein $R^1$ and $R^2$ are independently selected from the group consisting of a hydrogen atom and an alkyl group of 1 to 3 carbon atoms, or a water-soluble acid salt thereof, from about 6 to about 1200 grams per mole of said developing agent of a poly(alkyleneimine), and from zero to 0.25 moles of sulfite per mole of said developing agent.

5. A photographic color developer composition as claimed in claim 1 wherein said developing agent is p-phenylenediamine.

6. A photographic color developer compositon as claimed in claim 1 wherein said developing agent is an aminophenol.

7. A photographic color developer composition as claimed in claim 1 wherein said developing agent is 4-(N-ethyl-N-2-methanesulfonylaminoethyl)-2-methylphenylenediamine sesquisulfate monohydrate.

8. A photographic color developer composition as claimed in claim 1 which is free of sulfite ions.

9. A photographic color developer composition as claimed in claim 3 wherein said hydroxylamine has the formula:

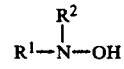

wherein $R^1$ and $R^2$ are independently selected from the group consisting of a hydrogen atom and an alkyl group of 1 to 3 carbon atoms.

10. A photographic color developer composition as claimed in claim 3 wherein said hydroxylamine is hydroxylamine sulfate.

11. A photographic color developer composition as claimed in claim 1 wherein said composition is an aqueous alkaline composition.

12. A photographic color developer composition as claimed in claim 1 wherein said composition is an acidic concentrate.

13. A method of retarding aerial oxidation of a primary aromatic amino color developing agent in a photographic color developing solution so as to increase the useful life of said solution, which method comprises incorporating in said solution an oxidation-inhibiting amount of a poly(alkyleneimine).

14. A method as claimed in claim 13 wherein said poly(alkyleneimine) is poly(ethyleneimine).

15. A method as claimed in claim 13 wherein said developing solution contains an hydroxylamine.

16. A method as claimed in claim 13 wherein said developing solution contains hydroxylamine sulfate, said developing agent is 4-(N-ethyl-N-2-methanesulfonylaminoethyl)-2-methylphenylenediamine sesquisulfate monohydrate, and said poly(alkyleneimine) is poly(ethyleneimine).

17. A process of color developing a photographic element which comprises contacting said element with a color developer solution containing a primary aromatic amino color developing agent stabilized against aerial oxidation with a poly(alkyleneimine).

18. A process as claimed in claim 17 wherein said poly(alkyleneimine) is poly(ethyleneimine).

19. A process as claimed in claim 17 wherein said developing solution contains an hydroxylamine.

20. A process as claimed in claim 17 wherein said developing solution contains hydroxylamine sulfate, said developing agent is 4-(N-ethyl-N-2-methanesulfonylaminoethyl)-2-methylphenylenediamine sesquisulfate monohydrate, and said poly(alkyleneimine) is poly(ethyleneimine).

* * * * *